US005190080A

United States Patent [19]

Peder

[11] Patent Number: 5,190,080

[45] Date of Patent: Mar. 2, 1993

[54] PROTECTIVE NETTING AND PROCESSES AND APPARATUS FOR THE PRODUCTION THEREOF

[75] Inventor: Fabio Peder, Laives, Italy

[73] Assignee: Eurock S.P.A., Milan, Italy

[21] Appl. No.: 606,839

[22] Filed: Oct. 31, 1990

[51] Int. Cl.[5] ..... B21F 27/08

[52] U.S. Cl. ..... 140/92.1; 140/9

[58] Field of Search ..... 245/2, 3, 4; 140/3 R, 140/4, 10, 11, 57, 92.1, 93 R

[56] References Cited

U.S. PATENT DOCUMENTS

| | | | |
|---|---|---|---|
| 496,087 | 4/1893 | Lamb et al. | 245/3 |
| 2,111,775 | 3/1938 | Hanson | 140/11 |
| 2,763,296 | 9/1956 | Lecoq | 140/3 CA |
| 3,388,725 | 6/1968 | Richardson | 140/93 R |
| 4,030,527 | 6/1977 | Roch | 140/92.1 |
| 4,121,629 | 10/1978 | Sackl et al. | 140/112 |
| 4,641,991 | 2/1987 | Yaoita . | |

FOREIGN PATENT DOCUMENTS

| | | |
|---|---|---|
| B-363765 | 8/1981 | Australia . |
| 2629492 | 10/1989 | France . |
| A-370902 | 9/1963 | Switzerland . |
| A-418045 | 2/1967 | Switzerland . |
| A-11098 | 7/1916 | United Kingdom . |

*Primary Examiner*—Lowell A. Larson
*Attorney, Agent, or Firm*—Keck, Mahin & Cate

[57] ABSTRACT

In a protective netting comprising a plurality of cables disposed in mutually crossed relationship, the two cables are fixedly connected together at the intersection thereof by connecting wires which are wound in a crossed arrangement around the intersecting cables.

1 Claim, 6 Drawing Sheets

PROTECTIVE NETTING AND PROCESSES AND APPARATUS FOR THE PRODUCTION THEREOF

BACKGROUND OF THE INVENTION

It is known for protective or guard mesh or netting to be used to safeguard mountain slopes against falls such as for example mudflows, to safeguard rock faces, in particular crumbly rock faces, from rock falls, and also to use them for avalanche protection structures. Typically the protective netting comprises cables in crossed-over relationship which are joined together at their respective intersections by connecting elements. The cables may be plastic cables, for example of nylon, or steel cables. The cables are formed into square or lozenge-shaped meshes to provide nets, by a manual operation. The cables are joined together at their respective intersections by connecting elements which may be for example in the form of small metal plates which are also pressed on to the cables by hand. A netting configuration of that kind is shown in FIG. 1 of the accompanying drawing, showing a small plate member as a connecting element 5 at the intersections 4 between each two cables 2 and 3. The illustrated netting may also involve small metal plate members which are pressed into position on both sides. The metal plate members comprise galvanised metal plate and the size of the meshes of the netting is generally from 200 to 300 mm. The cable diameter are between 5 and 10 mm. The netting can be made up from sub-portions which are surrounded by an edging cable which is from 10 to 22 mm in thickness. Those sub-portions may be from 3 to 10 meters in length and from 2 to 8 meters in height. The protective nettings are fitted by hand on a frame and the connection at the intersections between the cables is also effected manually by means of the metal plate members which are pressed together, as already referred to above. It will be seen therefore that the production of such a netting is a long and tedious manual procedure.

SUMMARY OF THE INVENTION

An object of the present invention is to provide a protective netting or mesh which ensures a long period of operational reliability and which can be produced by machine.

Another object of the present invention is to provide a protective netting comprising crossed-over cables which are joined at their intersections by a mechanical procedure.

Yet another object of the present invention is to provide a protective netting in which the crossed-over cables are securely joined together without adversely affecting the flexibility of the netting.

Still a further object of the present invention is to provide a protective netting which can be supplied in the form of modular elements which can be assembled to provide a larger netting structure.

Yet a further object of the present invention is to provide a process for the production of a protective netting, which involves a rational series of operating steps to produce the netting.

A yet further object of the present invention is to provide an apparatus for the production of a protective netting which is of a simple design configuration while being effective reliably to produce a satisfactory protective netting in a simple fashion by an at least largely automatic procedure.

In accordance with the principles of the present invention, in a first aspect, these and other objects are achieved by a protective netting or mesh comprising crossed-over cable portions such as steel cables which are joined together at their respective intersections by connecting elements. A connecting element at an intersection is formed from four windings or turns of first and second wires of smaller diameter than the crossed cable portions, wherein two turns or windings of the one wire are wound around the two cable portions adjacent to the intersection of the one cable and two turns or windings of the other wire are wound around the two cable portions adjacent the intersection of the other cable. The two turns or windings of the one wire are connected by way of a connecting wire portion which is disposed on one side of the netting and the two turns or windings of the other wire are connected by way of a connecting wire portion disposed on the other side of the netting, so that the two cables at the intersection lie between the two connecting wire portions.

In a further aspect of the invention the foregoing and other objects are achieved by a process for the production of a protective netting or mesh wherein a plurality of cable portions such as steel cables are disposed in crossed-over relationship at intersections and are connected together at said intersections. The cable portions at the respective intersection are connected with first and second wires, respective ones of which are wound around the two cable portions of each respective cable, which are adjacent to the intersection, in such a way that the two cables at the intersection are held between the two crossed wires.

In still another aspect of the invention the foregoing and other objects are achieved by an apparatus for the production of a protective netting or mesh comprising crossed-over cable portions such as steel cables which are connected together at their intersections, comprising a frame structure for carrying the cables in the form of a netting or mesh, and an XY-co-ordinate guide means for a carriage adapted to be equipped with a cable guide means for automatically applying one or more cables to the frame structure in the form of a netting thereon.

The invention can thus provide a protective netting or mesh which can comprise a plurality of crossed-over cables or cable portions, for example steel or plastic cables. Two wires are used as the connecting element at a respective intersection between the crossed-over cables, the wires being more flexible than the cables and preferably also being of smaller diameter than the cables. The two wires which perform the function of connecting wires are passed in crossed relationship around the respective intersection of the two cables or cable portions, with one wire being disposed on one side of the netting at the intersection between the two crossed cable portions, and the other wire being disposed on the other side of the netting at the same intersection. The two end portions of each wire are wound around the two cable portions of each cable, which are adjacent to the respective intersection. That provides at that location a fixed connection in respect of the two cables or cable portions at the intersections, with the connection being free from projecting edges. The netting structure according to the invention thereby guarantees in particular adaption of the netting when setting it in position in the open country, for example on rock faces and mountain slopes, including in the region of the intersections, as the connecting elements comprising the two connecting wires wound around the cables at the intersections have a certain degree of flexibility without the strength of the connection at the intersection suffering as a result.

As noted above, the wire connections at the intersections of the protective netting according to the invention can be produced by means of a simple process which in essence provides that the crossed cables are connected at the respective intersection by the first and second wires by a procedure wherein, starting from the middle of each wire, the two end portions of the wire are wound around the two cable portions of each cable, which are adjacent to the intersection, with a central connecting wire portion being laid transversely over the intersection so that the two cables at the intersection are held between the two crossed central portions of the two connecting wires.

Preferably the two wire portions which are wound around the two cable portions adjacent to the intersection are wound in opposite directions. That provides the desired connection between the crossed cables at the intersection by a simple winding operation involving two connecting wires being wound around the cables at the respective intersection of the netting.

As noted above, the apparatus according to the invention for the automatic production of a protective netting or mesh includes a frame for holding the cables in position in the form of a mesh or netting and XY-coordinate guide means for guiding a carriage to appropriate points in the frame structure. The carriage can be provided with a cable guide means which positions the cables on the frame structure to provide the network configuration. The carriage can also be provided with a cable connecting means with which the cables which are fitted to the frame in the form of a netting are connected at the respective intersections between the cables by means of connecting elements. They may involve connecting plate members which are connected to the crossed-over cables of the netting or mesh by being pressed thereon at the intersections between the cables. For that purpose the cable connecting means may include a suitable stamping or pressing device.

Preferably the carriage is guided on the XY-co-ordinate guide means, under the control of a computer. The computer stores the geometrical data of the netting or mesh and the frame structure, and the fixing locations for fixing the netting on the frame structure. The fixing locations can be in the form of direction-changing locations for the tensioned cables. That provides that the carriage is then moved to the corresponding fixing locations for tensioning of the cables in netting form. In addition that ensures that the carriage is moved in a defined manner to the respective intersection for applying the connecting elements by means of the cable connecting means.

The cable connecting means may also be so designed that it has a wire winding device with which two connecting wires are crossed over at the cable intersections and fixed by means of wire turns or windings to the adjacent cable portions at the respective intersections. In that way the crossed-over connecting wires then form connecting elements at the intersections between the cables of the netting.

For that purpose the wire winding device may have first and second winding elements, each of which can be aligned with the two cable portions of the respective cable, which are adjacent the respective intersection. The winding elements have entrainment means for the two wires which are wound at their end portions around the cable portions which are adjacent to the intersection. Preferably for that purpose the wire entrainment means and the winding elements are drivable in opposite directions of rotation. The two winding elements are preferably rotatable about a common axis of rotation which coincides with the longitudinal axis of the cable about which the wire windings or turns are to be made.

So that the wire windings or turns can be formed around the two crossed cables, the wire winding means which has the two winding elements is preferably pivotable about a pivot axis which is normal to the winding axis and extends through the center point of the cable intersection. If the crossing angle is 90°, the winding elements are pivoted through 90°.

Further objects, features and advantages of the invention will be apparent from the following description of preferred embodiments.

DESCRIPTION OF PREFERRED EMBODIMENTS

Figure 1:
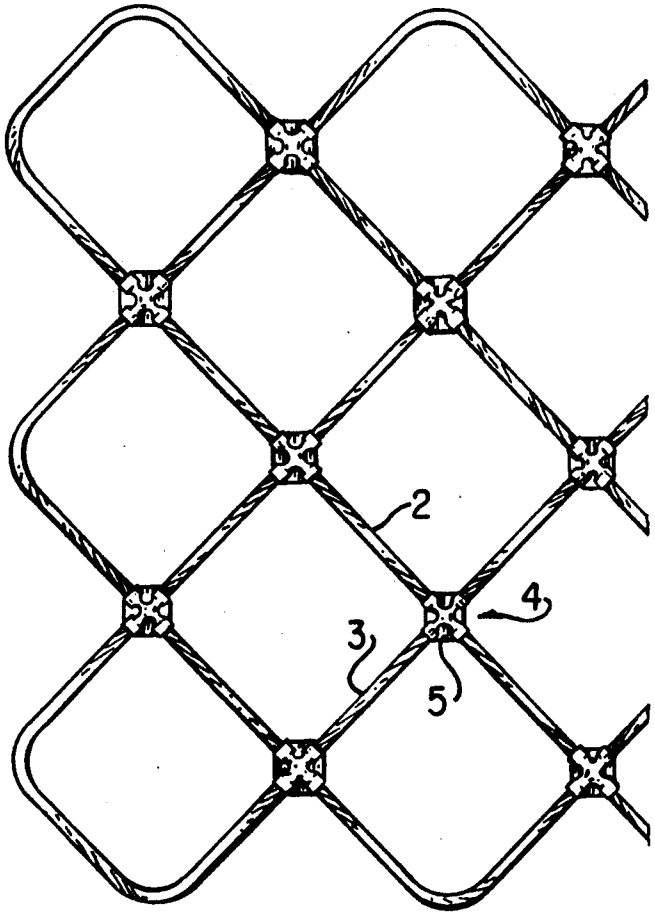
FIG. 1 shows a protective netting or mesh with conventional connecting elements at the intersections between the cables forming the netting or mesh.

The protective netting or mesh shown in FIG. 1 has already been described above, as constituting a previously known construction.

Figure 2:
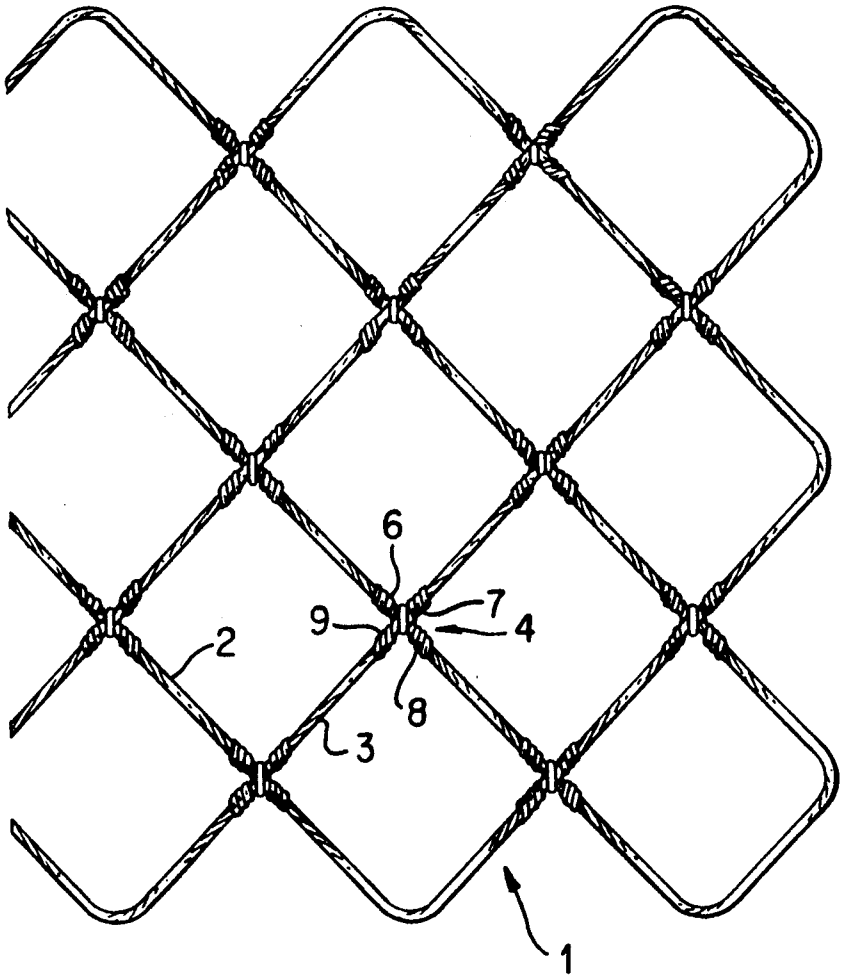
FIG. 2 shows a view corresponding to that shown in FIG. 1 of an embodiment of the netting or mesh according to the invention.

Reference will now be made to FIG. 2 showing an embodiment of a protective netting according to the invention. As illustrated the netting comprises cables 2 and 3 which are arranged in crossed relationship, with reference numeral 4 indicating an intersection at which two cables 2 and 3 cross each other. At each intersection 4, the illustrated netting has a connecting element which is shown in greater detail in FIG. 3, in the form of first and second wires 12 and 13 which are laid in crossed relationship with each other at the intersection 4. The two wires 12 and 13 have central connecting wire portions indicated at 10 and 11 which are arranged in mutually superposed and crossed relationship. In that respect the central connecting wire portion 10 is disposed in FIG. 3 on the back of the intersection 4 while the central connecting wire portion 11 is disposed on the front side of the intersection 4. The two connecting wire portions 10 and 11 are disposed at at least substantially the same intersection angle relative to each other, as the two cables 2 and 3.

The two end portions of a respective wire 12, 13 are wound in the form of turns or windings 6, 7 and 8, 9 respectively around the portions of the cables 2 and 3 which are adjacent to the respective intersection thereof as indicated at 4. That provides a fixed connecting element at the intersection 4 between the two cables 2 and 3, which connecting element however is still flexible to such an extent that the netting 1 can satisfactorily adapt to structures which occur for example in nature, as on a mountain slope or a rock face, without the cables being tensioned around sharp edges in the regions of the respective intersections 4.

Figure 4:
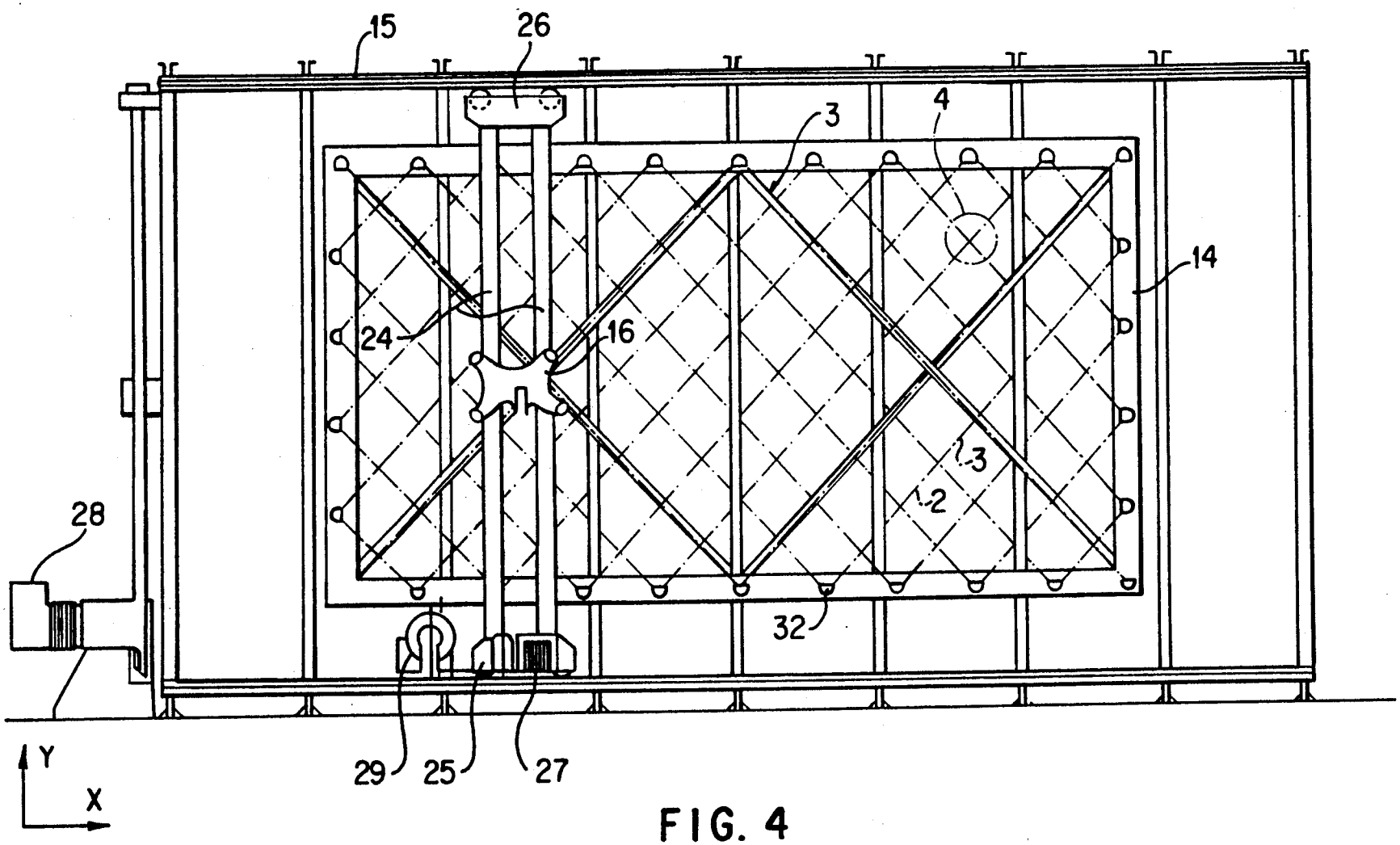
FIG. 4 is a side view of an apparatus for the production of a protective netting, as an embodiment of the invention.
Figure 5:
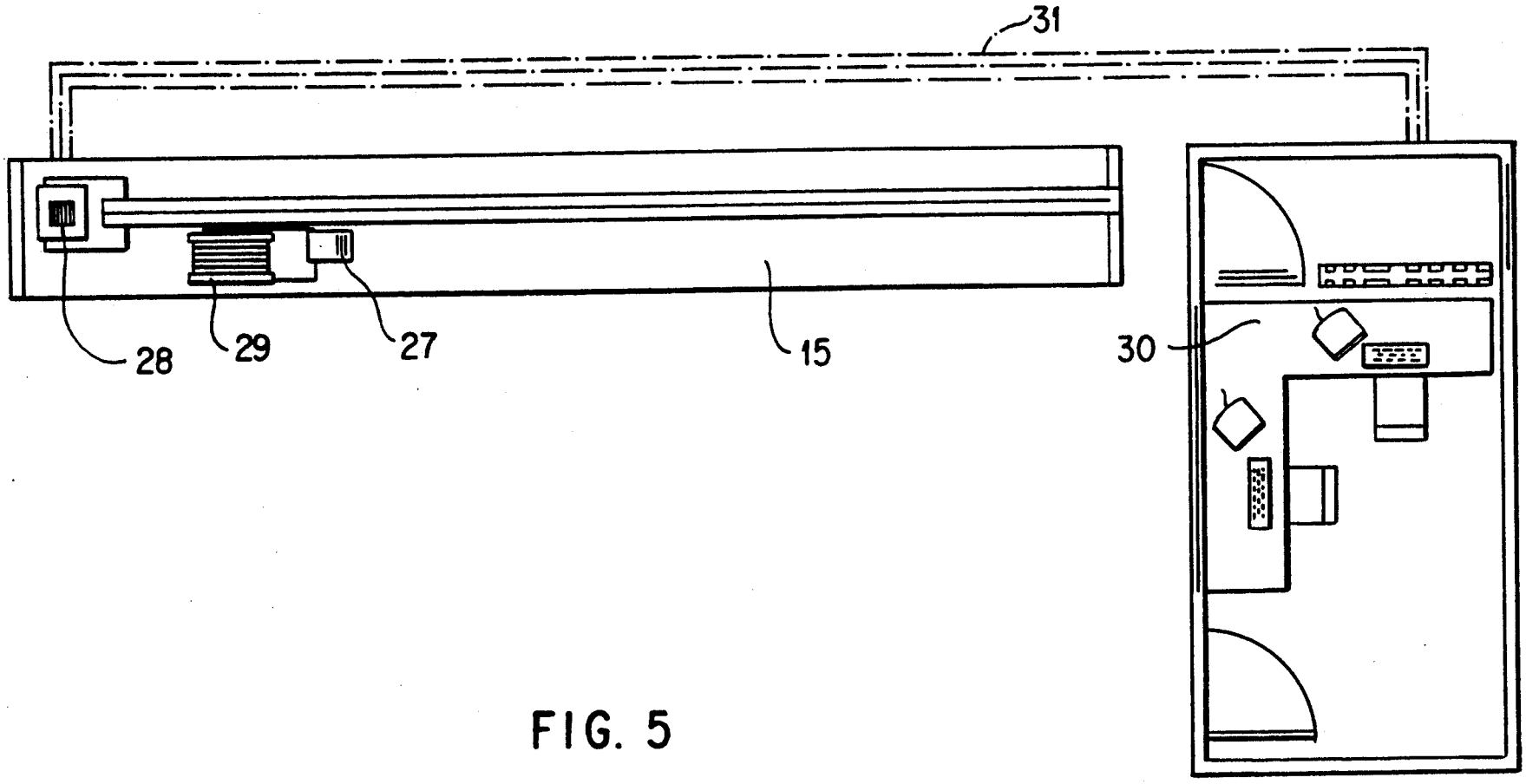
FIG. 5 is a plan view of the apparatus shown in FIG. 4.

Referring now to FIGS. 4 and 5, shown therein is an embodiment of an apparatus according to the invention for the automatic or machine production of a protective netting or mesh. As shown, the apparatus according to the invention comprises a frame 14 for laying out the cables 2 and 3 from which the netting or mesh 1 is formed. The frame 14 may be disposed horizontally or vertically or in any other position between the horizontal and vertical positions. The apparatus further comprises an XY-co-ordinate guide arrangement 15 for guiding a carriage 16. By means of the guide arrangement 15 the carriage 16 can be guided to the respective fixing locations indicated at 32 at which the cables 2, 3 are suitably secured to the frame 14, for example being in the form of projections around which the cables 2, 3 forming the netting are passed.

For fixing the netting 1 in the frame 14, the carriage 16 is provided with an unwinding device which is not shown in greater detail herein and which forms a cable guide means. The unwinding device is operable to unwind a cable from a supply bobbin as indicated at 29 in FIG. 4. The cable is then guided around the fixing locations 32 on the frame 14 and tensioned, thereby constituting the mutually crossing cables 2 and 3. For that purpose the unwinding device is moved with the carriage 16 on guide rails indicated at 24 in FIG. 4. The drive for that movement is produced by a motor 27. The guide rails 24 are guided movably on the frame-like XY-co-ordinate guide arrangement 15, in the X-direction thereof, on rolling carriages indicated at 25 and 26 in FIG. 4. The drive for that movement comes from a motor 28 which is supported on the frame-like guide arrangement 15 and the drive motion of which is transmitted to the upper rolling carriage 26.

The unwinding device also includes a mechanism for preventing the cable from becoming tangled, in order to ensure that the cable is satisfactorily laid in its appropriate position in the frame 14. As indicated above, the cable is unwound from the supply bobbin 29 and passed around the fixing locations 32 and tensioned so that the cables are then fixed to the frame 14, in the form of a netting or mesh. The movements performed by the carriage 16 are controlled in that operation by a computer indicated at 30 in FIG. 5, which is disposed in a control room. An operator can provide for the inputs into the computer 30, which are required for the arrangement to perform the necessary working steps. The procedure is initiated by characteristic data in respect of the netting or mesh to be produced, being inputted into the computer 30.

The supply bobbin 29 is of such a configuration that it independently supplies itself with the necessary amount of cable. There is therefore always sufficient cable to form by machine on the frame 14 the netting or mesh which is to be produced in accordance with the layout defined in the computer 30.

At the end of the cable tensioning operation the cable unwinding device disposed on the carriage 16 goes back to the starting position at which the leading end and the trailing end of the cable are connected together.

In that way the cable or cable portions 2, 3 which are unwound from the bobbin 29 in the form of a continuous cable run can be passed around the respective fixing locations 32 on the frame 14 and tensioned. The movement of the carriage 16 is controlled by the computer which stores the frame dimensions, the fixing locations 32 on the frame members and the configuration of the netting or mesh. The control data are supplied to the motors 27 and 28 by way of a line indicated at 31 in FIG. 5.

After the netting or mesh 1 has been tensioned on the frame 14, the cable unwinding device described above is replaced by a cable connecting device. The cable connecting device is mounted on the carriage 16 which is moved on the guide arrangement 15 on the guide rails 24 thereof in the Y-direction, by actuation of the motor 27. As already mentioned, the motor 28 moves the two guide rails 24 on the guide arrangement 15 in the X-direction thereof, by virtue of the two rolling carriages 25 and 26.

In that way, the cable connecting means can be moved to the respective intersections 4 between the cables 2 and 3. The cable connecting device is then operable to join two crossing cable portions 2 and 3 at their intersection 4. In that operation, the connecting plate members 5 shown in FIG. 1 may be automatically pressed on to the respective intersections 4 to form the connection between the mutually crossing cables 2 and 3. For that purpose the cable connecting device is preferably in the form of a fitting or pressing or stamping device so as to provide for automatic fitment of the connecting plate members 5 by virtue of being pressed into position on the crossing cables.

Figure 6:
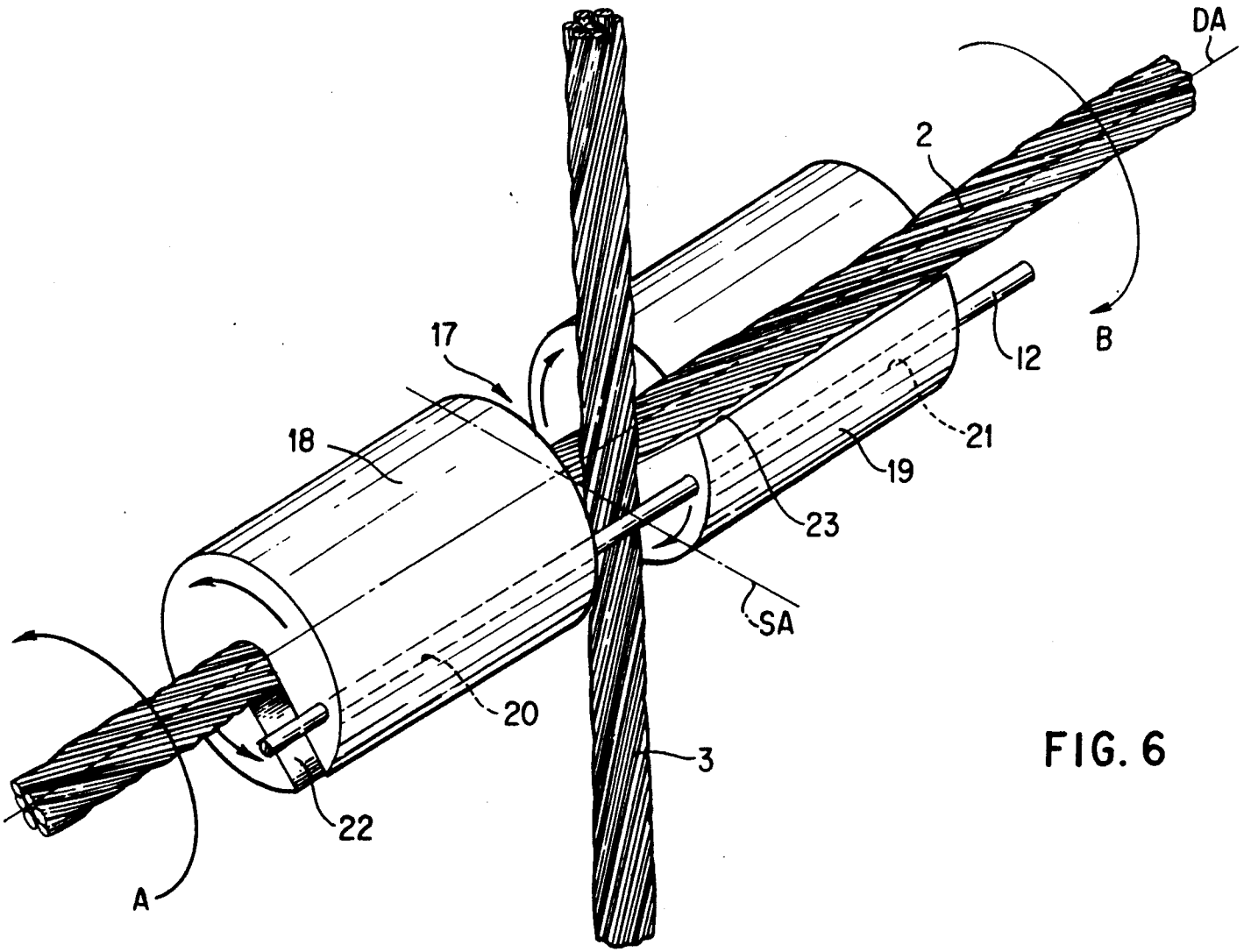
FIG. 6 shows a wire winding device of the apparatus according to the invention in the initial position of the first winding operation.
Figure 7:
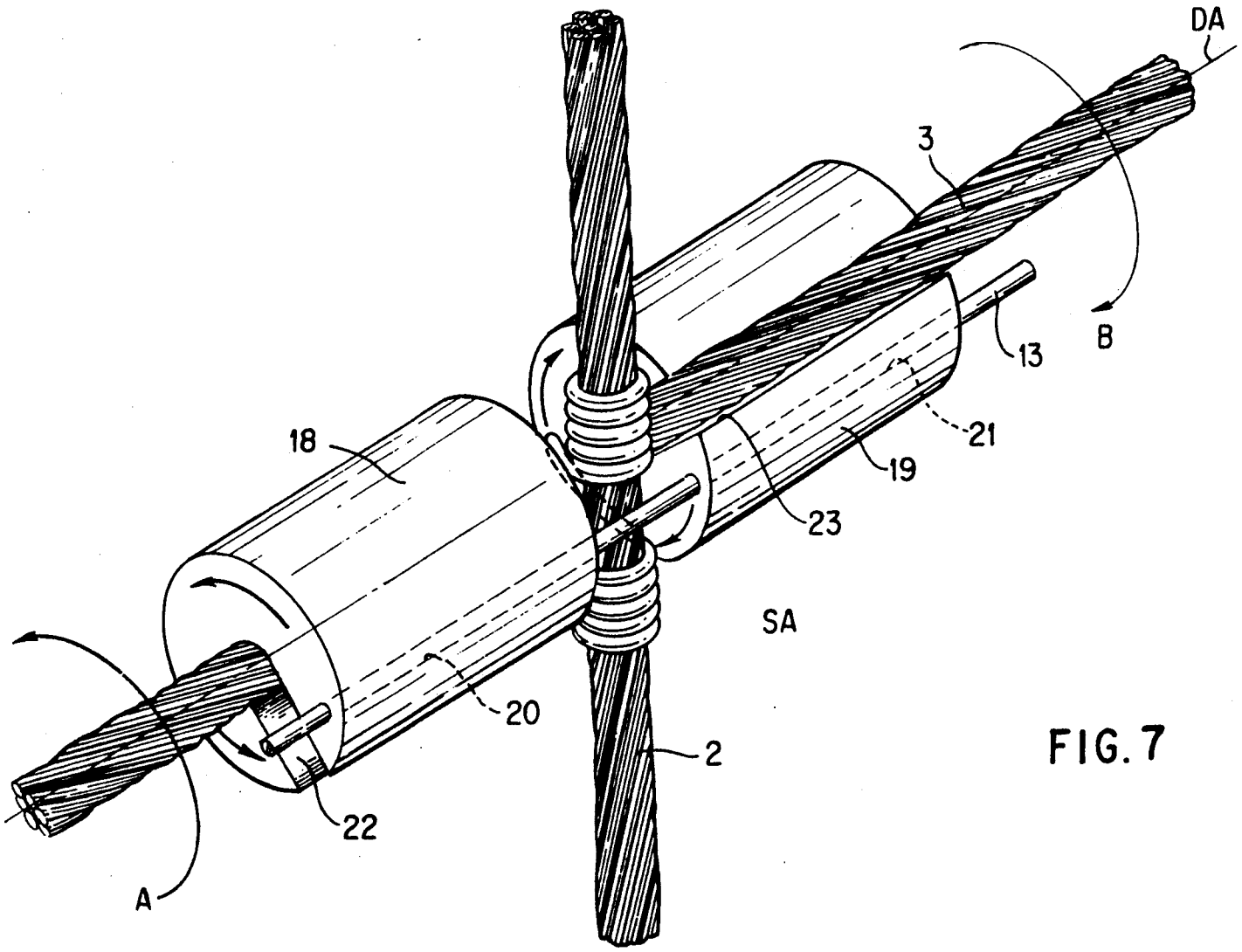
FIG. 7 shows the wire winding device illustrated in FIG. 6 in the starting position for a second wire winding operation.

The cable connecting device may alternatively comprise a wire winding device as shown in detail in FIGS. 6 and 7. The wire winding device which is indicated generally by reference numeral 17 in FIG. 6 comprises first and second winding elements 18 and 19 which are of a cylindrical configuration in the illustrated embodiment. The two winding elements 18 and 19 have a common axis of rotation as indicated at DA. In order to provide a rotary drive for the two winding elements 18 and 19, suitable drive means such as gears may be provided on each of the two winding elements 18 and 19 at the outwardly disposed ends thereof. The gears may be engaged with drive chains which are driven by a motor (not shown) to provide a common synchronous drive for the winding elements 18 and 19. It will be appreciated that the synchronous drive can also be produced in other ways, for example the drive motion can be transmitted to the two winding elements 18 and 19 by way of a gear transmission, or by way of toothed belts, or the like. In such an arrangement the toothed belts or the chain drive are disposed tangentially in relation to the gears which are mounted at the ends of the respective winding elements 18 and 19.

The cylindrical winding elements 18 and 19 have cable receiving recesses indicated at 22 and 23 in FIGS. 6 and 7. The cable receiving recesses 22 and 223 extend in the longitudinal direction of the respective winding elements 18 and 19. For the purposes of introducing the two cable portions of a respective cable 2 or 3, which are adjacent to an intersection 4, the two cable receiving recesses 22 and 23 are firstly aligned with each other in the longitudinal direction of the respective cable, for example the cable 2 as shown in FIG. 6. The cable portions adjacent to the intersection 4 can then be inserted into the cable receiving recesses 22 and 23, more specifically in such a way that the longitudinal axis of the cable portions received in the recesses 22 and 23 coincides with the axis of rotation DA of the two cylindrical winding elements 18 and 19.

As FIGS. 6 and 7 show, the cable which extends in crossed relationship with the cable 2 which has been inserted into the winding elements 18 and 19 extends between the mutually facing end faces of the two winding elements 18 and 19. The intersection 4 between the two cables 2 and 3 is also disposed between the two mutually facing end faces of the cylindrical winding elements 18 and 19.

After the cable, for example the cable 2 in FIG. 6 or the cable 3 in FIG. 7, has been inserted into the cable receiving recesses 22 and 23, the two winding elements 18 and 19 are turned so that the two cable receiving recesses 22 and 23 are then disposed at a right angle to each other, being the position shown for example in FIG. 6. In that way the two cable portions adjacent the intersection 4 are fixed in the two winding elements 18 and 19. With the two winding elements 18 and 19 in that position, wire entrainment means 20 and 21 which in the embodiment illustrated in FIGS. 6 and 7 are in the form of through bores in the winding elements 18 and 19 are aligned with each other. It may be noted at this stage however that the wire entrainment means may also be recesses extending in the longitudinal direction in the cylindrical body of the respective winding elements 18 and 19. The wire entrainment means 20 and 21 extend parallel to the axis of rotation DA and at a spacing therefrom which makes it possible for one of the connecting wires 12 and 13 to be inserted into the mutually aligned wire entrainment means or bores 20, 21, as shown in FIGS. 6 and 7. Disposed between the inserted connecting wire 12 or 13 and the cable which is inserted into the cable receiving recesses 22 and 23, being the cable 2 in FIG. 6 or the cable 3 in FIG. 7, is the other cable (cable 3 in FIG. 6 and cable 2 in FIG. 7) which is in crossed relationship with the first-mentioned cable. After the connecting wire 12 or 13 has been inserted into the mutually aligned wire entrainment means 20 and 21, the wire winding device 17 is in its starting position for performing a winding operation. That starting position is shown in FIG. 6 in relation to the first wire winding operation and in FIG. 7 in relation to the second wire winding operation.

Figure 3:
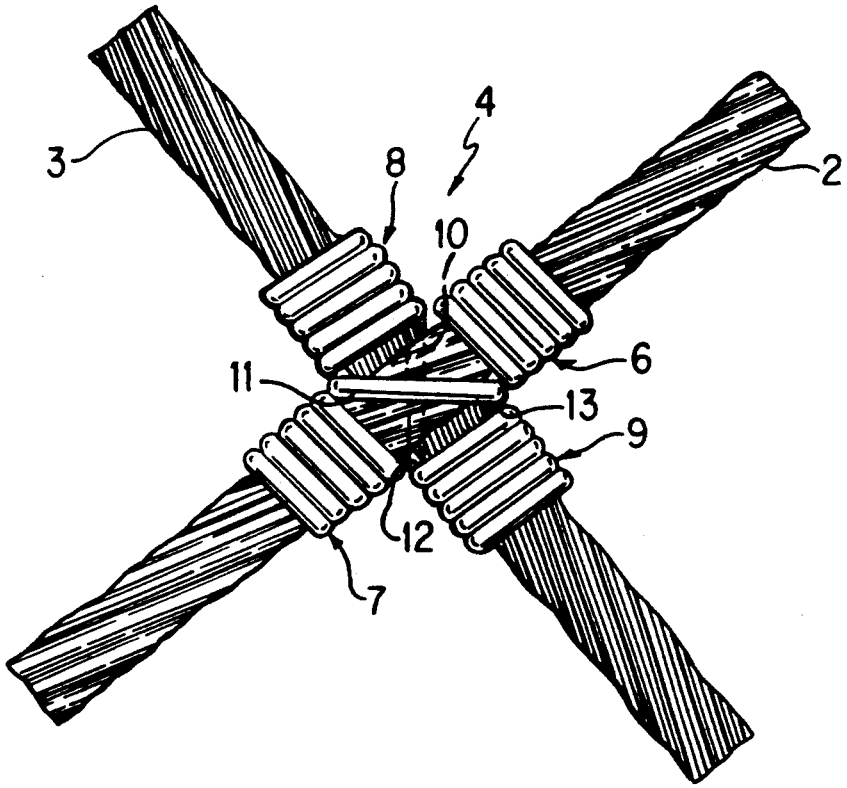
FIG. 3 is a view on an enlarged scale of a connecting element at an intersection in an embodiment of the netting according to the invention.

To produce the windings shown at 6, 7 and 8, 9 in FIG. 3, the two winding elements 18 and 19 are turned around the common axis of rotation DA. In that operation the winding element 18 is turned in the direction indicated by arrow A in FIG. 6 and the winding element 19 is turned in the direction indicated by arrow B in FIG. 6. The directions of rotation of the two winding elements 18 and 19 are thus in opposite relationship to each other. During that rotary movement, the wire portions which are guided in the wire entrainment means or bores 20 and 21 are wound around the cable portions which are adjacent to the intersection 4, to provide the connecting structure shown in FIG. 3. After the conclusion of the winding operation in which the connecting wire 12 has been wound around the cable 2 in FIG. 6, the winding elements 18 and 19 are disengaged from the cable 2 and turned through an angle which corresponds to the angle of intersection between the two cables 2 and 3. In the illustrated embodiment that angle is an angle of 90°. The axis about which that pivotal movement takes place, as indicated at SA in FIG. 6, extends through the center of the intersection 4 between the cables 2 and 3 and is normal to the axis of rotation DA. The winding elements 18 and 19 then occupy the position shown generally in FIG. 7 in which they are associated with the other cable 3. Then, in the same manner as already described above in connection with FIG. 6, the portions of the cable 3 are inserted into the cable receiving recesses 22 and 23, the two winding elements 18 and 19 then being turned into a position in which the two cable receiving recesses 22 and 23 are in mutually normal relationship, being the condition of the structure shown in FIG. 7. The connecting wire 13 is then introduced into the wire entrainment means 20 and 21 in the winding elements 18 and 19 in the same manner as described above with reference to FIG. 6. The portion of the cable 2 which already has the connecting wire 12 wound therearound and the central connecting wire portion 10 of which passes around the portion of cable disposed between the two winding elements 18 and 19 is disposed between that portion of the cable 3 and the connecting wire 13. That is then the starting position for the second winding operation which is then carried out in the same manner as the first winding operation in FIG. 6. In that situation the two windings 8 and 9 are formed on the cable 3, with the central connecting wire portion 11 being passed around the cable 3 at the intersection 4 between the cables 2 and 3.

The connection shown in FIG. 3, at the point of intersection between the cables 2 and 3, is then finished. In that finished connecting elements, two windings 6 and 7 each consisting of four turns of wire have been formed around the cable 2 and two windings 8 and 9 each consisting of four turns of wire have been formed around the cable 3. The windings 6, 7, 8 and 9 are thus formed by the end portions of the two wires 12 and 13. The central connecting portions 10 and 11 of the respective wires are passed around the crossed portions of the cables 2 and 3 at the intersection 4 thereof. The windings 6 and 7 of the connecting wire 12 are carried on the cable 2 and the central connecting wire portion 10 of the wire 12 is laid diagonally on one side of the netting or mesh around the portion of the cable 3 which is disposed in the region of the intersection 4. Similarly, the windings 8, 9 of the wire 13 are carried on the cable 3 while the central connecting wire portion 11 of the wire 13 is laid diagonally on the other side of the netting or mesh and over the portion of the cable 2 which is in the region of the intersection 4. In that way the two cables 2 and 3 are firmly joined together at the intersection 4 by the connecting wire portions 10 and 11 which are disposed on the cables 2 and 3 in crossed relationship at respective sides thereof.

The above-described protective netting or mesh may be put to the uses referred to above although it will be appreciated that the area of use of the netting or mesh according to the invention is not restricted thereto. The netting or mesh according to the invention may be used in any situation where there is a wish for tear-resistant and stable safety installations in the form of netting or mesh, for example blast nets, catch nets, on racetracks and the like. The protective netting or mesh can be supplied in the form of netting elements and a plurality of such netting elements can be assembled together to provide a protective netting which is suitable anchored in the region of use thereof.

It will be appreciated that the foregoing structures and process have seen set forth solely by way of example and illustration of the present invention and that various modifications and alterations may be made therein without thereby departing from the spirit and scope of the invention.

What is claimed is:

1. The apparatus for the production of a protective netting comprising crossed-over cables which are connected together at their intersections, comprising:

a frame for arranging the cables in the form of netting, and an XY co-ordinate guide means, a carriage adapted to move on said guide means in mutually normal directions, and on said carriage a cable guide means for automatically laying out at least one cable in netting form on the frame, wherein the carriage is adapted for removal of the cable guide means and fitting with a cable connecting means in place of the cable guide means.

* * * * *